US011542060B2

(12) United States Patent
Rodrigues et al.

(10) Patent No.: US 11,542,060 B2
(45) Date of Patent: Jan. 3, 2023

(54) PACKAGE FOR CONSUMER GOODS AND METHOD FOR MANUFACTURING A TEAR-OPEN PACKAGE

(71) Applicant: Altria Client Services LLC, Richmond, VA (US)

(72) Inventors: Luiz Andre Rodrigues, Neuchatel (CH); Onesio Luis Thesing, Ecublens (CH); Timothee Cailleaux, Divonne-les-Bains (FR)

(73) Assignee: Altria Client Services LLC, Richmond, VA (US)

( * ) Notice: Subject to any disclaimer, the term of this patent is extended or adjusted under 35 U.S.C. 154(b) by 167 days.

(21) Appl. No.: 15/926,305

(22) Filed: Mar. 20, 2018

(65) Prior Publication Data

US 2018/0273239 A1 Sep. 27, 2018

Related U.S. Application Data

(63) Continuation of application No. PCT/EP2018/056112, filed on Mar. 12, 2018.

(30) Foreign Application Priority Data

Mar. 21, 2017 (EP) ..... 17161948

(51) Int. Cl.
*B65D 17/28* (2006.01)
*B65D 75/14* (2006.01)
(Continued)

(52) U.S. Cl.
CPC ..... *B65D 17/4011* (2018.01); *B65D 75/14* (2013.01); *B65D 75/20* (2013.01);
(Continued)

(58) Field of Classification Search
CPC .... B65D 75/14; B65D 75/20; B65D 75/5816; B65D 75/5827; B65D 17/4011; B65D 17/4012; B65D 17/401; B65D 17/402
(Continued)

(56) References Cited

U.S. PATENT DOCUMENTS 2,248,266 A * 7/1941 Abrams ..... B65D 75/5816 206/484
3,623,653 A * 11/1971 Work ..... B65D 75/26 229/87.05
(Continued)

FOREIGN PATENT DOCUMENTS

CN 100335380 C 9/2007
CN 103339040 A 10/2013
(Continued)

OTHER PUBLICATIONS

Decision to Grant and Search Report dated Jun. 22, 2021, issued in corresponding Russian Patent Application No. 2019133105.
(Continued)

*Primary Examiner* — Derek J Battisti
(74) *Attorney, Agent, or Firm* — Harness, Dickey & Pierce, P.L.C.

(57) ABSTRACT

The package includes a sheet material with a first end and a second end, the first end being connected to the second end to form a sealing flap, the sealing flap sealing the package along at least a transversal edge of the sheet material, longitudinal edges of the sheet material being connected to each other. The sealing flap defines an opening cut, the opening cut being arranged in a sealed portion of the package. A first part of the sheet material forms a first package face, the sealing flap being connected to the first package face.

13 Claims, 3 Drawing Sheets

(51) Int. Cl.
*B65D 75/20* (2006.01)
*B65D 75/58* (2006.01)
*B65D 17/00* (2006.01)

(52) U.S. Cl.
CPC ..... *B65D 75/5816* (2013.01); *B65D 75/5827* (2013.01); *B65D 17/08* (2013.01); *B65D 2501/24146* (2013.01); *B65D 2517/002* (2013.01)

(58) Field of Classification Search
USPC ..... 383/200
See application file for complete search history.

(56) References Cited

U.S. PATENT DOCUMENTS

| | | | | |
|---|---|---|---|---|
| 3,741,778 | A * | 6/1973 | Rowe | B65D 75/56 426/107 |
| 4,428,477 | A | 1/1984 | Cristofolo | |
| 4,428,485 | A * | 1/1984 | Egli | B65D 5/06 206/524.8 |
| 2007/0237434 | A1 | 10/2007 | McKellar | |
| 2011/0150371 | A1 | 6/2011 | Bosman et al. | |
| 2011/0204056 | A1 | 8/2011 | Veternik et al. | |

FOREIGN PATENT DOCUMENTS

| | | | |
|---|---|---|---|
| DE | 20006820 | U1 | 7/2000 |
| DE | 212009000003 | U1 | 11/2009 |
| EP | 1683736 | A2 | 7/2006 |
| GB | 2112745 | A | 7/1983 |
| JP | H07215362 | A | 8/1995 |
| JP | 3073049 | U | 11/2000 |
| JP | 2001/240085 | A | 9/2001 |
| JP | 2003/516278 | A | 5/2003 |
| JP | 2005-516865 | A | 6/2005 |
| JP | 2007-30932 | A | 2/2007 |
| JP | 2007-153350 | A | 6/2007 |
| JP | 2009-255947 | A | 11/2009 |
| JP | 2013-180828 | A | 9/2013 |
| JP | 2014-51296 | A | 3/2014 |
| JP | 2016-501799 | A | 1/2016 |
| KR | 2001/0053601 | A | 6/2001 |
| KR | 200397706 | Y1 | 10/2005 |
| KR | 2013/0140825 | A | 12/2013 |
| RU | 2604025 | C2 | 12/2016 |

OTHER PUBLICATIONS

Office Action dated Jun. 8, 2021, issued in corresponding Chinese Patent Application No. 201880014430.5.
Office Action dated Jan. 24, 2022, issued in corresponding Japanese Patent Application No. 2019/550858.
Extended European Search Report dated Sep. 6, 2017, from related EP application 17161948.9.
International Search Report and Written Opinion dated Apr. 19, 2018 for related PCT Application No. PCT/EP2018/056112.
Written Opinion of the International Preliminary Examining Authority dated Mar. 11, 2019 in corresponding International Application No. PCT/EP2018/056112.
International Preliminary Report on Patentability dated May 27, 2019 for corresponding PCT Application No. PCT/EP2018/056112.
Office Action dated Oct. 12, 2022, issued in corresponding Korean Patent Application No. 10-2019-7026595.
Office Action dated Oct. 31, 2022, issued in corresponding Japanese Patent Application No. 2019/550858.

* cited by examiner

PACKAGE FOR CONSUMER GOODS AND METHOD FOR MANUFACTURING A TEAR-OPEN PACKAGE

CROSS-REFERENCE TO RELATED APPLICATIONS

This application is a continuation of, and claims priority to, international application number PCT/EP2018/056112, filed on Mar. 12, 2018, and further claims priority under 35 USC § 119 to European patent application number 17161948.9, filed on Mar. 21, 2017, the entire contents of each of which are incorporated herein by reference.

FIELD

Example embodiments relate to a package for consumer goods and a method for opening such a package. In particular, example embodiments relate to a tear-open package and opening method with a multi-action opening for accessing the consumer good in the package. Example embodiments also relate to a method for manufacturing a tear-open package.

DESCRIPTION OF RELATED ART

To enable opening packages made of tear resistant material, edges or seams of the package may be provided with a notch from which a tear can propagate more easily through the material. A notch may be arranged completely within the seam of the package. High precision in the notch location can make manufacturing expensive. A seam may be used instead of a notch, though this can lead to loss of space inside a package or a waste of material.

SUMMARY

At least one example embodiment is directed toward a package for consumer goods.

In one embodiment, the package includes a sheet material with a first end and a second end, the first end being connected to the second end to form a sealing flap, the sealing flap sealing the package along at least a transversal edge of the sheet material, longitudinal edges of the sheet material being connected to each other, the sealing flap defining an opening cut, the opening cut being arranged in a sealed portion of the package, a first part of the sheet material forming a first package face, the sealing flap being connected to the first package face.

In one embodiment, the first end includes a first portion and a second portion, the first portion defining the opening cut, the sealing flap being connected to the first package face such that the first portion is sealed between the second portion and the first package face.

In one embodiment, the connection between the longitudinal edges of the sheet material is stronger than the connection between the sealing flap and the first package face.

In one embodiment, the first end defines the opening cut with a cut angle having a longitudinal axis that is +/−45 degrees relative to the longitudinal edges of the sheet material.

In one embodiment, the first end and the second end both define the opening cut.

In one embodiment, the sheet material includes a center panel, a first side panel and a second side panel, the second panel forming a second package face for the package, the first side panel and the second side panel both depend from transverse sides of the center panel, the first side panel and the second side panel forming the first package face.

In one embodiment, the sheet material includes a first sheet face and a second sheet face, the longitudinal edges of the sheet material being connected to each other by the first sheet face being folded onto itself and sealed along the longitudinal edges, the first end being connected to the second end by connecting ends of the first sheet face to each other.

In one embodiment, the sheet material defines an incomplete weakening line at a desired (or alternatively, predefined) tearing distance relative to the opening cut.

At least one example embodiment is directed toward a method for manufacturing a tear-open package.

In one embodiment, the method includes providing a strip of sheet material; folding the sheet material onto itself to form a first package face and a second package face; sealing the sheet material along opposed longitudinal edges of the sheet material; fixing two end portions of the sheet material to each other to form a sealing flap; providing an opening cut in the sealing flap, the opening cut passing through the sealing flap, the opening cut being arranged in a sealed portion of the sealing flap; and connecting the sealing flap to the first package face.

In one embodiment, the connecting of the sealing flap to the first package face includes connecting longitudinal flap edges of the sealing flap to the first package face.

In one embodiment, the method further includes folding an outer first flap portion of the sealing flap into an inner second flap portion before connecting the sealing flap to the first package face.

In one embodiment, the method further includes providing an incomplete weakening line in the sheet material at a desired (or alternatively, predefined) tearing distance relative to the opening cut, the incomplete weakening line being arranged in a direction perpendicular to a longitudinal axis, the longitudinal axis being parallel to the opposed longitudinal edges of the sheet material.

BRIEF DESCRIPTION OF THE DRAWINGS

Features described in relation to one example embodiment may equally be applied to other example embodiments.

Example embodiments will now be described with reference to the following drawings.

DETAILED DESCRIPTION

Figure 1:
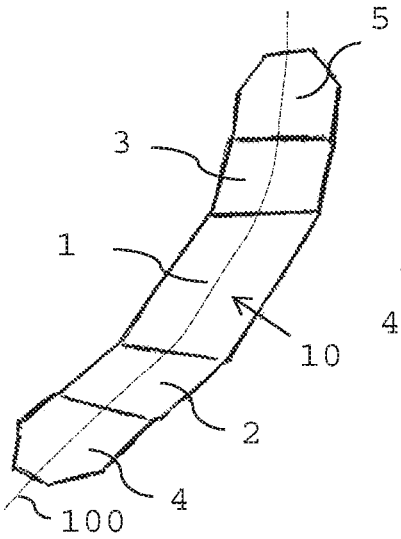
FIG. 1 illustrates a step in a manufacturing process for a tear open package, in accordance with an example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, etc. may be used herein to describe various elements, regions, layers and/or sections, these elements and/or sections should not be limited by these terms. These terms are only used to distinguish one element or section from another section. Thus, a first element, or section discussed below could be termed a second element, or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

When the words "about" and "substantially" are used in this specification in connection with a numerical value, it is intended that the associated numerical value include a tolerance of ±10% around the stated numerical value, unless otherwise explicitly defined. When reference is made to percentages of compositions of materials or chemicals, it is intended that those percentages are based on weight, i.e., weight percentages.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

General Methodology

Example embodiments provide a tear-open package and a method for opening the tear-open package that is easy to open while preventing accidental opening. The package can be manufactured reliably without endangering the sealing properties of the package.

Example embodiments provide a method for opening the tear-open package. The method includes a first step of peeling off a sealing flap from a first package face. A second step includes folding a first flap portion of the sealing flap onto itself thereby exposing an opening cut at the created fold of the first flap portion. The opening cut passes through the sealing flap and is completely arranged in the sealing flap. A third step relates to tearing the folded first flap portion next to the opening cut in opposite directions thereby tearing open the sealing flap and the package to gain access to the content of the package.

Specific Example Embodiments

In the opening method of example embodiments, the opening cut is not accessible without primarily manipulating the package in a defined manner. In a first step the sealing flap has to be peeled-off from the first package face in order to be able to access the opening cut. Secondly, the sealing flap has to be folded in a specific manner such that tearing the package along the opening cut is possible.

An intermediate step between the first and the second step of the opening method may include unfolding the first flap portion of the sealing flap from a second flap portion of the sealing flap. Thus, advantageously, before peeling off the sealing flap from the first package face, the opening cut is not visible and protected by the remaining packaging material.

With the opening cut arranged in the first flap portion, and with the additional folding of the sealing flap, the opening cut is arranged between the second flap portion and the first package face and becomes visible only after the sealing flap has been peeled off. The opening cut becomes operable only after unfolding of the first flap portion from the second flap portion and after folding the first flap portion onto itself.

In the method for opening according to example embodiments, the step of folding the first flap portion onto itself may include folding the first flap portion along an indicator provided at the first flap portion. The indicator indicates a folding position of the first flap portion for exposing the opening cut at the new fold. The indicator supports positioning the folding of the first flap portion, either by optical or other physical means. The indicator may, for example, be an arrow or arrows, a drawn line, a printed line or a tactile indicator.

After tearing the folded flap portion next to the opening cut, the method for opening a tear-open package may include the step of subsequently tearing at least one of the torn-apart parts of the folded flap portion along an incomplete weakening line. Such an incomplete weakening line may be arranged along a direction perpendicular to a longitudinal axis of the package.

The incomplete weakening line is a line in the sheet material where the thickness of the material is reduced, without penetrating through the entire material. In an embodiment, the incomplete weakening line is a laser scoring in the sheet material. Alternatively, where the material is a multilayer material, the incomplete weakening line may be a cut that goes through one layer of the material but leaves another layer of the multilayer material intact. Thus, the sheet material provided with the incomplete weakening line includes the same characteristics relative to gas or liquid tightness as the sheet material without the incomplete weakening line.

In an example embodiment, the incomplete weakening line is arranged such that the tearing open process initiated by the opening cut and by the orientation of the opening cut relative to the package is redirected into the direction of and along the incomplete weakening line. Since the sheet material along the incomplete weakening line requires less force to be torn than the sheet material not provided with the incomplete weakening line, the sheet material will automatically be torn apart along the incomplete weakening line.

In an example embodiment, the incomplete weakening line is arranged at a desired (or alternatively, predefined) tearing distance to the opening cut. In an embodiment, a tearing distance amounts to a few millimeters, for example 3 millimeters to 15 millimeters, or, 4 millimeters to 12 millimeters. However such a tearing distance may vary depending on a size of the package, the size of the opening cut and for example on the sheet material of the package.

By the provision of the incomplete weakening line and a redirection of the original opening direction, an opening may effectively be initiated by the opening cut and subsequently be redirected in order to define parts of the package to be torn apart or be torn off from the remaining package. In particular, with a redirection of the tearing motion, for example a sealing flap or portions of the sealing flap may be torn away without destroying the pouch containing a consumer good.

In an example embodiment, an opening cut is arranged at a cut angle between plus and minus 45 degree relative to a longitudinal axis of the package or, for example, arranged parallel to opposing longitudinal flap edges. In an embodiment, the cut angle is between plus and minus 30 degree, or between plus and minus 15 degree or between plus and minus 5 degree relative to the longitudinal axis. In an embodiment, the sealing flap includes a first flap portion and a second flap portion. The sealing flap is folded.

Advantageously, the opening cut is provided parallel to the longitudinal axis of the package (cut angle of 0 degree), for example to opposed longitudinal flap edges. In this case the longitudinal axis corresponds to a center line through the sheet material or through the package.

In an example embodiment, the opening cut is entirely arranged in a sealed portion of the sealing flap.

Thus, the incomplete weakening line may be arranged substantially perpendicular to the opening cut and may be substantially perpendicular to the longitudinal axis of the package. 'Substantially perpendicular' is herein meant to include an angle of between plus or minus 45 degree to an exact perpendicular (90 degree) arrangement between opening cut and incomplete weakening line.

Example embodiments provide a package for consumer goods. The package includes a sheet material having opposed first and second sheet faces. The first sheet face is folded onto itself and is sealed along longitudinal sheet edges. The first sheet face is fixed to itself, for example by sealing or by an adhesive, forming a sealing flap, wherein the sealing flap seals the package along at least a transversal sheet edge. The sealing flap includes an opening cut, wherein the opening cut passes through the sealing flap and is completely arranged in a sealed portion of the sealing flap. The sealing flap is folded onto a first package face including a connection between sealing flap and first package face.

By this, the opening cut is not accessible without further manipulation of the package.

In an example embodiment, the sealing flap includes a first flap portion and a second flap portion. The sealing flap is folded onto the first package face such that the first flap portion includes the opening cut that is arranged between the second flap portion and the first package face. By this, the opening cut is not visible without further manipulation of the package as already described above relating to the opening method for such packages. The opening cut is also not accessible without further manipulation of the package as already described above relating to the opening method for such packages.

The package includes a connection between the sealing flap and the first package face. Such a connection secures the sealing flap on the package and prevents or reduces the risk of accidental opening of the sealing flap.

In an example embodiment, a connection between sealing flap and first package face is less strong than a sealing between the first sheet face along the longitudinal sheet edges. The less strong connection allows for peeling-off the sealing flap while the sealing of the package itself remains unaffected. This supports a controlled opening of the package which may reduce a risk of an uncontrolled falling out of an article from the package.

A less strong connection or stronger connection is herein understood as requiring less force or more force, respectively, to disengage or loosen the connection. A less strong connection between sealing flap and first package face is herein understood as a connection requiring less force to disengage or loosen than the force required for disengaging or loosening the sealing between the first sheet face along the longitudinal sheet edges.

In an example embodiment, a connection between sealing flap and first package face requires a force between 18 N and 22 N to disconnect or loosen.

In an example embodiment, a sealing between the first package face along the longitudinal sheet edges requires a force of at least 30 N to disconnect or loosen.

The connection between sealing flap and first package face may be a connection by sealing, by adhesive or by micro-suction of the appropriate package material.

For opening the package, the sealing flap has to be peeled from the first package face. In order to allow ripping the flap material along the opening cut, the opening cut must be positioned at an exterior position of the sealing flap. To achieve this, the first flap portion is folded onto itself, and may be folded in half, such that the new fold of the folded first flap portion extends through the opening cut. By this, the opening cut comes to lie across the new fold. The folded first flap portion may now be torn next to the opening cut in opposite directions. Thereby the sealing flap and further parts of the package are torn open, allowing access to the content of the package.

In some embodiments, the first flap portion has to be unfolded from the second flap portion before being folded onto itself.

The package according to some example embodiments may require three, or even four actions to open. Two, or three actions are required to get the opening cut into the tearing position. A third or fourth action, respectively relates to the tearing open of the package.

In an example embodiment, the opening cut is a longitudinal cut defining a direction in which the package material is torn apart.

In an example embodiment, the opening cut includes a cut angle with a longitudinal axis parallel to the opposed longitudinal sheet edges. In am embodiment, the cut angle is between plus and minus 45 degree relative to the longitudinal axis. In an embodiment, the cut angle is between plus and minus 30 degree, or between plus and minus 15 degree or between plus and minus 5 degree relative to the longitudinal axis. Advantageously, the opening cut is arranged parallel (cut angle of 0 degree) to the opposed longitudinal sheet edges and parallel to the opposed sealing flap edges.

The opening cut may be arranged centrally in the package, and may be along a center line through a package or through the sheet material the package is formed with. A central arrangement supports a substantially symmetric opening of the package, for example a tearing of the package in two halves. A central arrangement also diminishes the possibility that only a small side part of the sealing flap or of the package is torn away.

Alternatively, an opening cut may be provided along a side seam of the sealing flap such that the package can be torn up along that side seam. The open package then becomes a cup-shaped pouch.

The sheet material of the package may be provided with the incomplete weakening line at a desired (or alternatively, predefined) tearing distance to the opening cut. Function, advantages and example embodiments of the incomplete weakening line have already been described above relating to the disclosed opening method.

The incomplete weakening line is arranged at least partly or entirely in a non-sealed portion of the package. In an embodiment, the incomplete weakening line is arranged to at least 80 percent in a non-sealed portion of the package. Or, the incomplete weakening line is arranged in a non-sealed portion of the package except for a sealing along longitudinal sheet edges.

In an example embodiment, the incomplete weakening line extends to at least 50 percent over a width of a package. Or, the incomplete weakening line extends to at least 70 percent over a width of a package. For example, the incomplete weakening line extends over 60 percent to 95 percent of the width of a package.

When an opening cut is arranged in a first flap portion, the incomplete weakening line may be arranged in a second flap portion. In an embodiment, then only the first flap portion of the sealing flap is sealed and the second flap portion of the sealing flap is not sealed. The incomplete weakening line may also be provided not in the sealing flap but, for example, in the pouch of the package.

The sealing flap, and in an embodiment the first flap portion, may include an indicator indicating the position of a folding line along the sealing flap, or along the first flap portion, and across the opening cut. An indicator supports positioning the folding of the covered flap portion, either by optical or other physical means. An indicator may, for example, be an arrow or arrows, a drawn line, a printed line or a tactile indicator. In an embodiment, a sealing flap is arranged symmetrically on the first package face. This may improve stacking of the articles, in particular where a packed article in the package is substantially flat.

The sealing flap of the package may be arranged in a middle section of the first package face, for example in a middle section of the package that extends between about 25 percent and about 75 percent of the length of the package. The sealing flap may be arranged in the middle of the package that is at about 50 percent of the length of the package.

The sealing flap may also be arranged at either one or at both of the longitudinal ends of the package. In an embodiment, the sealing flap includes an opening cut arranged at one longitudinal end of the package.

Depending on the desired position of the sealing flap a manufacturing method of the package is selected, or depending on the desired manufacturing process the position of the sealing flap is defined.

The package may be made of any material suitable for packing a desired consumer good. In an embodiment, the package is made of tear resistant sheet material, for example plastics materials or laminated plastics materials such as for example polypropylene or other packaging materials known from food or medical industries. In an embodiment, the package material is sealable to form the various seams. The package material may also be a micro-suction material allowing to create connections between the package materials based on under pressure.

The package according to some embodiments may contain consumer goods such as for example edible products, medical products, aerosol-forming substrates (vapor-forming substrates) or articles including aerosol-forming substrates used in electronic devices. In an embodiment, the package includes an aerosol-forming substrate, for example a tobacco or nicotine containing aerosol-forming (e.g., vapor-forming) substrate.

The method for opening a tear-open package may be realized in various embodiments of packages, mainly depending on the way the package has been manufactured, namely on the process the sheet material is folded and sealed.

According to some first embodiments of the package, the first sheet face is folded onto itself and is sealed along opposed longitudinal sheet edges such as to form a first package face and a second package face. The first and second end portions are fixed to each other, for example by sealing or an adhesive, forming a sealing flap. The sealing flap includes an opening cut. The opening cut passes through the first and second end portion and is completely arranged in the sealing flap. The sealing flap is folded onto the first package face and includes a connection between sealing flap and first package face. Thus, the opening cut is completely arranged within the sealing flap and does not extend, for example, up to edges of the sealing flap.

In these embodiments of packages the sealing flap may be arranged at a longitudinal end of the package or may be arranged in a middle section. Embodiments of packages with sealing flaps arranged in a middle section of the package includes a center panel of the sheet material that forms the second package face. Two side panels depend from two transverse sides of the center panel and are folded onto the center panel. The two side panels form the first package face. The two end portions of the sheet material forming the sealing flap depend from the two side panels. If the two side panels have the same length, then each of the two side panels is a half panel and forms half of the first package face. In this embodiment the sealing flap extends exactly from the middle of the package and is folded along a transverse middle folding line in either direction onto the first package face.

To support a folding of the first flap portion and a covering of the first flap portion underneath the second flap portion of the sealing flap, the first flap portion may include a tapered sheet portion. In an embodiment, the sheet material of the package includes cut-away corners forming trapezoidal sheet material end portions.

According to some second embodiments of the package, the package for consumer goods includes a sheet material having opposed first and second sheet faces. The first sheet face is folded onto itself along a longitudinal direction of the sheet material and is sealed along the longitudinal sheet edges such as to form a tube. The first sheet face at opposed longitudinal ends of the tube is fixed to itself in end portions, one of the end portions forming a sealing flap. The sealing flap includes an opening cut, wherein the opening cut passes through the sealing flap and is completely arranged in the sealing flap. The sealing flap is folded onto a first package face including a connection between sealing flap and first package face.

Such packages may be manufactured using current manufacturing processes and equipment, where an endless tube of tear-resistant material may be formed by a lengthwise folding and longitudinal sealing of the sheet material. The endless tube may then be sealed (provided with transversal seals) at desired (or alternatively, predefined) distances, cut into individual lengths, filled with a consumable to be packed and sealed at an opposed longitudinal end of the tube. In these packages a sealing flap is arranged at one longitudinal end of the package. Thus, a package is opened from one longitudinal end of the package.

Next to the different manufacturing process and different sealing locations required to form a package, the features of the sealing flap are the same for all packages. For example, a sealing flap may be folded onto itself before being sealed to the first package face such that the opening cut is not visible on the package before peeling off the sealing flap from the first package face. Since the opening cut is arranged entirely within the sealing flap, and in an embodiment entirely within a sealed portion of the sealing flap, the opening cut is not recognizable when the sealing flap has been folded onto itself before being sealed to the first package face.

Position and arrangement of opening cuts, an incomplete weakening line for redirecting a tearing direction, a type of sealing and strength of sealing, sheet materials for the package and content of the package have been described relating to the method for opening a tear-open package according to example embodiments and these features are likewise applicable to the first and second embodiments of packages.

According to some example embodiments, there is further provided a method for manufacturing a tear-open package. Depending on the design of the package to be manufactured or on the manufacturing equipment, the manufacturing methods for the different embodiments of packages may be chosen and may differ accordingly.

For manufacturing packages according to the first embodiments of packages as described herein, the method includes the steps of providing a strip of sheet material, folding the sheet material onto itself forming a first package face and a second package face and sealing the sheet material along opposed longitudinal sheet edges. The sealing to form the package may be done by heat sealing, but may also be done, for example, by an adhesive or other sealing means suitable for sealing such packages. A further method step includes fixing two end portions of the sheet material to each other forming a sealing flap and providing an opening cut in the sealing flap. The opening cut passes through the sealing flap and is arranged entirely in the sealing flap. Yet a further step of the manufacturing method is folding the sealing flap to the first package face.

In an example embodiment, the method includes the step of folding an outer first flap portion of the sealing flap to an inner second flap portion before folding the sealing flap to the first package face. In an embodiment, this is done such that the opening cut is not visible on the package when the sealing flap is folded to the first package face.

By this, first flap portion comes to lie between the second flap portion and the first package face. Accordingly, the opening cut arranged in the first flap portion is covered by the first flap portion.

The manufacturing method allows to manufacture packages of tear resistant materials, wherein the means of opening the package is not directly accessible and may also not be visible.

In an example embodiment, a further method step includes connecting the sealing flap to the first package face along opposed longitudinal flap edges. The connecting of the flap to the first package face may be a comparatively weak connection such as to connect the flap to the package but not provide significant effort to peel off the sealing flap. In an embodiment, a stronger sealing is provided between the first sheet face along the opposed longitudinal sheet edges than the connection between sealing flap and first package face along the opposed longitudinal flap edges. This is advantageous in order to not inadvertently open the package at the longitudinal sealing edges when pulling at the flap.

The step of folding the sheet material onto itself for forming the package may include folding two side panels depending from two transverse sides of a center panel of the sheet material onto the center panel. This is performed such that the two side panels come to lie on the center panel and such that the two end portions of the sheet material forming the sealing flap extend from a first package face formed by the two side panels of the sheet material. Each side panel may form a larger or smaller part of the first package face, while both side panels together form the entire first package face. In an embodiment, each side panel forms half of the first package face.

The two end portions of the sheet material may be sealed to form the sealing flap, for example by heat sealed. Such a sealing may be done before or after sealing the opposed longitudinal sheet edges. A sealing of the two end portions may be as strong as the sealing of the opposed longitudinal sheet edges. If the sealing flap is formed by gluing or adhering the two end portions of the sheet material together by adhesive, then the first sheet face of the sheet material may be provided with an adhesive or glue in the region of the two end portions, before the sheet material is folded onto itself and before starting to fold the package.

The step of providing an opening cut may include providing the opening cut at a cut angle between plus and minus 45 degree relative to a longitudinal axis parallel to the opposed longitudinal flap edges. In an embodiment, the cut angle is between plus and minus 30 degree, or between plus and minus 15 degree or between plus and minus 5 degree relative to the longitudinal axis. Advantageously, the opening cut is provided parallel to the opposed longitudinal flap edges (cut angle of 0 degree). In this case the longitudinal axis may correspond to a center line through the sheet material or the package.

In an example embodiment, the opening cut is entirely arranged in a sealed portion of the sealing flap.

In an example embodiment, the method further includes the step of fixing the first flap portion to the second flap portion before folding the sealing flap onto the first package face and before a possible sealing of the sealing flap to the first package face. Such a fixing may be performed, for example, by a small dot of adhesive or by a weak or laterally limited sealing or microsuction. In an embodiment, such a fixing guarantees that the first flap portion remains in its folded position until the sealing flap is folded onto the first package face. Advantageously, a smooth manufacturing process of the package is thereby facilitated.

The method for manufacturing tear-open packages may further include the step of providing the incomplete weakening line in the sheet material at a desired (or alternatively, predefined) tearing distance to the opening cut. Thereby, the incomplete weakening line may be arranged in a direction perpendicular to a longitudinal axis, which longitudinal axis is arranged parallel to the opposed longitudinal sheet edges. Function and arrangement of the incomplete weakening line have already been described relating to the method for opening a tear-open package and these features relate to the package.

For manufacturing packages according to second embodiments of packages as described herein, the method includes the steps of providing a strip of sheet material, folding the sheet material onto itself along a longitudinal direction of the sheet material and sealing the sheet material along the longitudinal sheet edge such as to form a tube. The sealing to form the package may be done by heat sealing but may also be done, for example, by an adhesive or other sealing means suitable for sealing such packages.

A further method step includes sealing two opposed end portions of the tube, one of the sealed end portion forming a sealing flap. Yet a further step includes providing an opening cut in the sealing flap. The opening cut passes through the sealing flap and is arranged entirely in the sealing flap. A subsequent step in the manufacturing method includes folding the sealing flap to the first package face.

Also the manufacturing method for packages according to second embodiments may include further method steps such as, for example: folding an outer first flap portion of the sealing flap to an inner second flap portion before folding the sealing flap to the first package face; performing a stronger sealing along the longitudinal sheet edge than the sealing between sealing flap and first package face along the opposed longitudinal flap edges; providing an incomplete weakening line in the sheet material at a desired (or alternatively, predefined) tearing distance to the opening cut, wherein the incomplete weakening line is arranged in a direction perpendicular to a longitudinal axis, which longitudinal axis is arranged parallel to the opposed longitudinal sheet edges; or wherein providing an opening cut includes providing the opening cut at a cut angle between plus and minus 45 degree relative to a longitudinal axis parallel to the opposed longitudinal flap edges. Advantages and further features have been described relating to the opening method according to the example embodiments, relating to the packages and relating to the manufacturing of first embodiments of packages and will not be repeated.

Example Structural Embodiments

FIG. 1 illustrates a strip of sheet material, for example a sealable plastic metal laminate, according to an example embodiment. The sheet material includes a first sheet face 10, which is folded onto itself to form the package.

The sheet material includes several panels: a center panel 1, a first and a second side panel 2,3 depending from the center panel 1 on each transverse side of the center panel, a first end portion 4 and a second end portion 5 depending from the first and second side panels 2,3 on a transverse side of the respective side panels.

The strip of sheet material includes cut-away corners such that the first and second end portions 4,5 comprise a trapezoidal edge portion.

The corresponding panels and portions of the sheet material shown in FIG. 1 are symmetric and have a same size.

The sheet material and panels are symmetric with respect to a center line 100.

Figure 2:
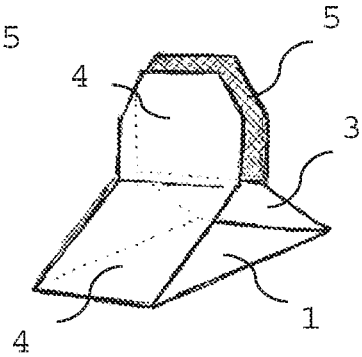
FIG. 2 illustrates a step in the manufacturing process for the tear open package, in accordance with an example embodiment.
Figure 3:
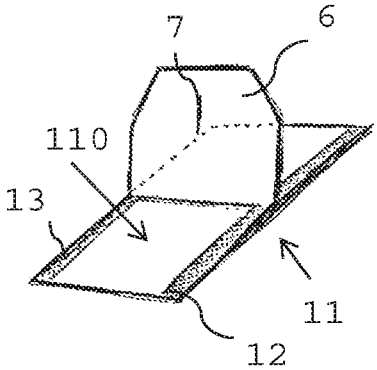
FIG. 3 illustrates a step in the manufacturing process for the tear open package, in accordance with an example embodiment.

The sheet material is folded onto itself such that the center panel 1 and the first and second side panels 2,3 form a pouch 11 for an article to be packed, as shown in FIG. 2 and FIG. 3.

The second sheet face of the center panel 1 forms the second package face. The second sheet face of the first and second side panels 2,3 forms the first package face 110.

For simplicity reasons the article to be packed is not shown in the drawings. However, an article may be provided before the sheet material is folded but at least before the sheet material is sealed.

As may be seen in FIG. 2, upon folding the sheet material the first sheet face 10 of the first and second end portions 4,5 come to lie against each other and extend from the first package face 110 formed by the first and second side panels 2,3.

The opposed longitudinal edges 12,13 of the center panel 1 and the side panels 2,3 are sealed forming the longitudinal package seams and closing the package along the opposed longitudinal edges 12,13. Also, the two end portions 4,5 are connected, and may be sealed, thereby forming a sealing flap 6. The first sheet face 10 of the end portions 4,5 may also be provided with an adhesive such that the two end portions may be glued together.

The sealing flap 6 depends from the center of the first package face 110.

The sealing flap 6 is provided with an opening cut 7 which passes through the sealing flap 6. The opening cut 7 is arranged in the center of the sealing flap 6 with respect to and parallel to the opposed longitudinal edges 12,13. The opening cut 7 is entirely arranged in the sealing flap 6 and may entirely be in a sealed area of the sealing flap 6. In an embodiment, the entire sealing flap 6 is sealed.

Figure 4:
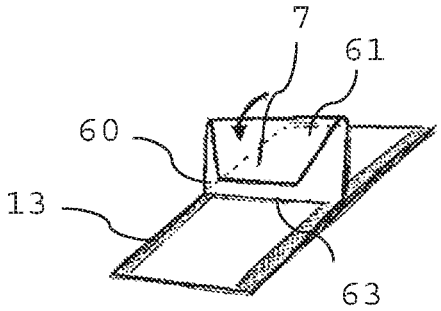
FIG. 4 illustrates a step in the manufacturing process for the tear open package, in accordance with an example embodiment.
Figure 5:
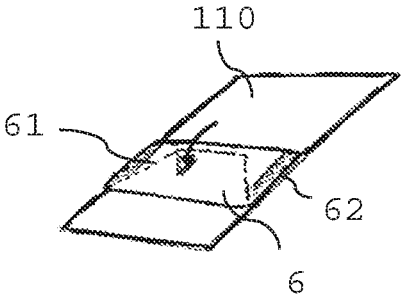
FIG. 5 illustrates a step in the manufacturing process for the tear open package, in accordance with an example embodiment.
Figure 6:
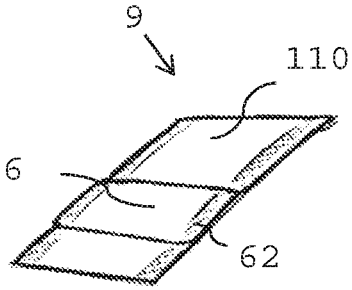
FIG. 6 illustrates a tear-open package and an opening process for the tear-open package, in accordance with an example embodiment.
Figure 7:
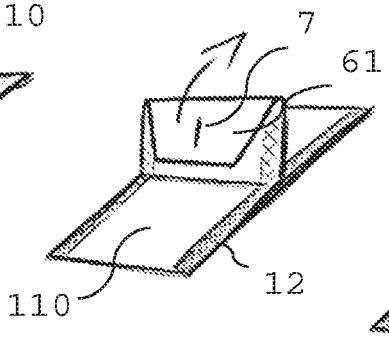
FIG. 7 illustrates a step in the opening process for the tear-open package, in accordance with an example embodiment.
Figure 8:
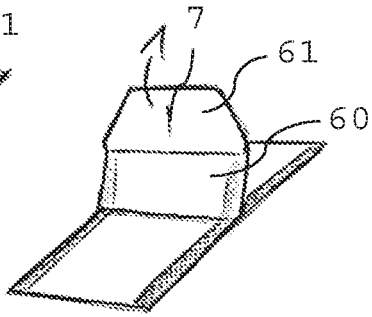
FIG. 8 illustrates a step in the opening process for the tear-open package, in accordance with an example embodiment.
Figure 10:
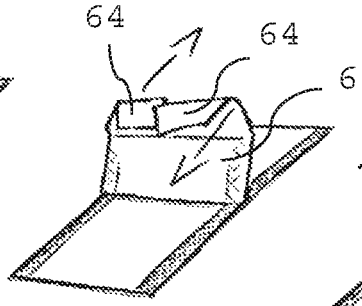
FIG. 10 illustrates a step in the opening process for the tear-open package, in accordance with an example embodiment.
Figure 11:
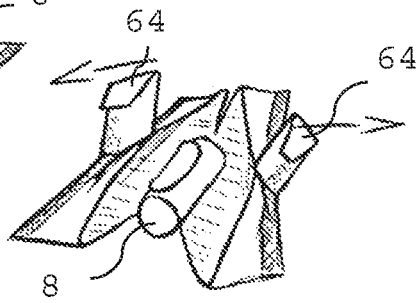
FIG. 11 illustrates a step in the opening process for the tear-open package, in accordance with an example embodiment.

In a next manufacturing step, which is shown in FIG. 4, the sealing flap 6 is folded onto itself. Thereby, the trapezoidal shaped outer portion 61 of the sealing flap 6 includes the opening cut 7 that is folded to come to lie on an inner sealing flap portion 60. The folded sealing flap 6 is folded along a folding line 63 arranged in the middle of the first package face 110, such that the sealing flap 6 comes to lie on the first package face, as shown in FIG. 5. Thereby, the trapezoidal shaped outer portion 61 includes the opening cut 7 that is covered by the exposed inner sealing flap portion 60, which is neither visible nor directly accessible. The opposed sealing flap edges 62 may be connected to the opposed longitudinal edges 12,13 of the first package face 110. In an embodiment, such a flap connection is weaker than the sealing of the pouch 11. In FIG. 6, an embodiment of a package 9 (assembled configuration) is shown, in accordance with an example embodiment. For opening the package, in a first step the sealing flap 6 is peeled-off from the first package face 110, as shown in FIG. 7. A moving direction is indicated by arrows. Thereby the inner flap portion 61 includes the opening cut 7 that is visible. In a second step, as shown in FIG. 8, the inner flap portion 61 is unfolded, thereby exposing the entire sealing flap 6 and in particular exposing the opening cut 7. In a third step, shown in FIG. 9, the inner flap portion 61 is folded in half, thereby forming a new fold 71. The opening cut 7 comes to lie on this new fold 71 and is now accessible for tearing at the sealing flap 6. The sealing flap 6 may now be torn in opposite directions, as indicated by arrows in FIG. 10. One may tear at the flap 6 on the two sides 64 of the opening cut 7 in the new fold 71. Due to the opening cut arranged in the center of the flap, the sealing flap 6 is substantially torn in half. Further tearing tears open the pouch 11 of the package 9. The complete opening of the package 9 may be supported by an opposite sideway tearing, as shown in FIG. 11. Thereby, the article 8 in the package becomes accessible.

Figure 9:
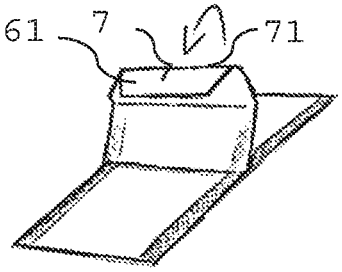
FIG. 9 illustrates a step in the opening process for the tear-open package, in accordance with an example embodiment.

In a basic manufacturing process, the sealing flap 6 as shown in FIG. 3 is directly sealed to the first package face 110, omitting the folding step shown in FIG. 4. Accordingly, in an opening process, the unfolding step, as shown in FIG. 7, is not available. The step of peeling the sealing flap 6 from the first package face, as shown in FIG. 7, is directly followed by the folding of the outer flap portion 61 onto itself, as shown in FIG. 9.

Figure 12:
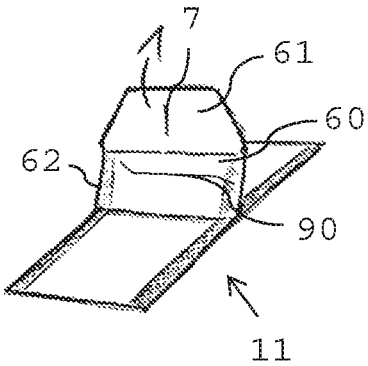
FIG. 12 illustrates a package provided with an incomplete weakening line, in accordance with an example embodiment.

FIG. 12 illustrates a package similar to the one shown in the previous figures. However, the sealing flap of the package of FIG. 12 is only entirely sealed in the outer flap portion 61 including the opening cut 7. The inner flap portion 60 is only sealed along the two opposed longitudinal flap edges 62. An incomplete weakening line 90 is provided in the sheet material of the inner flap portion 60. The incomplete weakening line 90 extends substantially perpendicular to the flap edges or the longitudinal sheet edges, respectively. The incomplete weakening line 90 is arranged centrally in the sealing flap 6 and extends over substantially the entire width of the inner flap portion 61, but is not arranged in the opposed sealed flap edges 62. The sheet material along the incomplete weakening line 90 requires less force to be torn than the portion of the sheet material that is not provided with an incomplete weakening line 90. The incomplete weakening line 90 serves to redirect the opening motion in a longitudinal direction of the package initiated by the orientation of the opening cut 7 in the outer flap portion 61 to a transversal direction of the package. By this the package can be opened without damaging the pouch 11 where the consumable is accommodated in.

Figure 13:
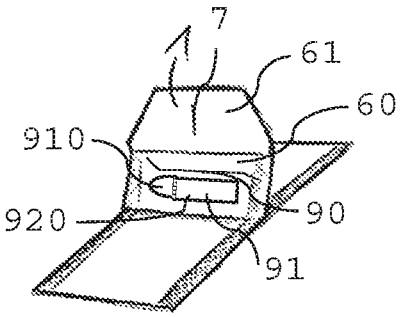
FIG. 13 illustrates the package with the incomplete weakening line and a reclosable tab, in accordance with an example embodiment.

FIG. 13 illustrates an embodiment of a reclosable package. The sealing flap 6 of the package of FIG. 13 is provided with an opening cut 7 in the outer sealed flap portion 61 and with an incomplete weakening line 90 in the inner non-sealed flap portion 60.

Additionally, a reclosable tab 91 is arranged a distance from and parallel to the incomplete weakening line 90 in the inner flap portion 60. The reclosable tab 91 includes a smaller adhesive free grip part 910, by which the tab 91 may be gripped and opened. The major closing part 920 of the reclosable tab 91 is provided with a reclosable adhesive, for example pressure sensitive adhesive (PSA).

The package is 'opened' by tearing apart the sealing flap 6 along the opening cut 7 and subsequently along the incomplete weakening line 90.

The inner flap portion 60 with its reclosable adhesive keeps the inner flap portion 60 closed.

Figure 14:
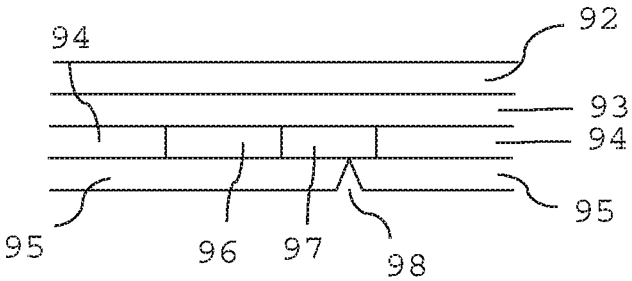
FIG. 14 illustrates a layered sheet material with the incomplete weakening line, in accordance with an example embodiment.

FIG. 14 illustrates a cross-section through an exemplary layered sheet material with a reclosable tab, in accordance with an example embodiment. The sheet material includes a first layer made of poly-inert material (polyethylene, polypropylene and/or polyvinyl chloride) 92 and a second laser made of aluminium 93. A polyethylene terephthalate (PET) layer 95 is attached to the aluminium layer 93 by an adhesive layer 94. The adhesive layer 94 is interrupted by a portion of PSA 96 and an adhesive free portion 97. The PET layer 95 is provided with an incomplete weakening line such as a laser scoring 98. The laser scoring 98 enables the removal of the PET layer 95 in the free portion 97 and the PSA portion 96. The PSA portion allows the re-adhering of the removed PET flap to the aluminium covered poly-inert layer 92.

Figures 15, 16:
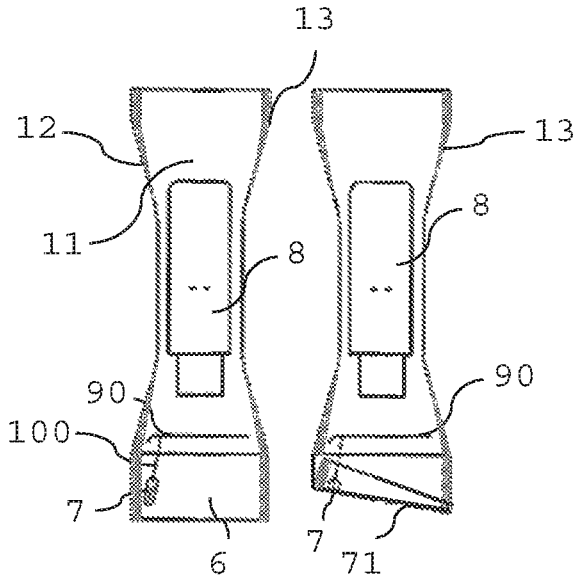
FIG. 15 illustrates another package and opening process, in accordance with an example embodiment.
FIG. 16 illustrates another package and opening process, in accordance with an example embodiment.

FIG. 15 and FIG. 16 illustrate an embodiment of a package with a sealing flap 6 arranged at a longitudinal end of the package, in accordance with an example embodiment.

As shown in FIG. 15, the package includes the sealing flap 6 already peeled off from the first package face. As shown in FIG. 16, the package includes the opening cut 7 arranged at the new fold 71 and ready to be torn open.

The sheet material is folded onto itself, and folded by half its length and sealed along the opposed longitudinal sheet edges 12,13, thereby forming a pouch 11. In the pouch 11 an article 8 is accommodated.

The open end of the formed pouch 11 is sealed forming a sealing flap 6. An opening cut 7 is arranged in the sealing flap 6. The opening cut passes through the sealing flap 6. The opening cut 7 is arranged at an angle of about 20 degree to 30 degree to a longitudinal axis of the package. The orientation of the opening cut 7 defines a tearing open direction 100 of the package.

The sheet material of the pouch 11 is provided with an incomplete weakening line 90. The incomplete weakening line 90 is arranged perpendicular to the longitudinal axis of the package and a few millimeters, for example 1 to 5 millimeters, spaced apart from the sealing flap 6. The incomplete weakening line 90 extends over about 95 percent of the width of the package and may extend into the sealing of the opposed longitudinal sheet edges.

As shown in FIG. 16, the sealing flap is folded onto itself, thereby positioning the opening cut 7 at the new fold 71. The sealing flap is folded askew, such that a larger portion of the sealing flap 6 is folded on one lateral side of the package than at the other lateral side. In the embodiment shown in FIG. 16, the sealing flap is folded at an angle between 20 to 30 degrees relative to the transverse direction of the package, such that the new fold 71 comes to lie perpendicular to the opening cut 7.

Figures 17, 18:
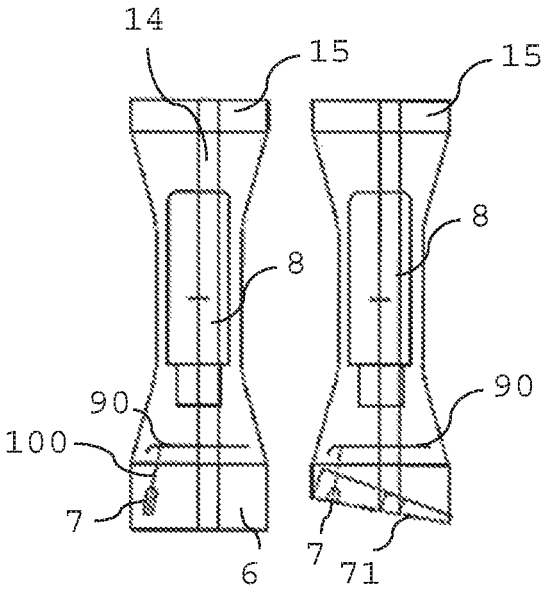
FIG. 17 illustrates another package and opening process, in accordance with an example embodiment.
FIG. 18 illustrates another package and opening process, in accordance with an example embodiment.

FIG. 17 and FIG. 18 illustrate the same opening method and a same arrangement and positioning of sealing flap, opening cut and incomplete weakening line, as shown in FIGS. 15 and 16, but include an embodiment of a differently manufactured package.

As shown in FIG. 17, the package includes the sealing flap 6 already peeled off from the first package face. As shown in FIG. 18, the package includes the opening cut 7 arranged at the new fold 71 and ready to be torn open.

The package shown in FIGS. 17 and 18 is an embodiment including one longitudinal seal 14 along the longitudinal sheet edges. The sheet material is folded onto itself by folding the sheet material along its longitudinal direction. The resulting manufactured tube is sealed at both ends, and may be after insertion of an article 8 is inserted in the package. One of the two sealed end portions forms the sealing flap 6. The sealing flap 5 has a longitudinal extension which is larger than the opposed sealed end portion 15 of the tube.

An opening cut 7 is arranged in the sealing flap 6. The opening cut passes through the sealing flap 6. The opening cut 7 is arranged at an angle of about 20 degree to 30 degree relative to a longitudinal axis of the package. The orientation of the opening cut defines a tearing open direction 100 of the package.

The sheet material of the pouch 11 is provided with an incomplete weakening line 90. The incomplete weakening line 90 is arranged perpendicular to the longitudinal axis of the package and a few millimeters, for example 1 to 5 millimeters, spaced apart from the sealing flap 6. The incomplete weakening line 90 extends over about 95 percent of the width of the package and may extend into the sealing of the opposed longitudinal sheet edges.

As shown in FIG. 18, the sealing flap is folded onto itself, thereby positioning the opening cut 7 at the new fold 71. The sealing flap is folded askew, such that a larger portion of the sealing flap 6 is folded on one lateral side of the package than at the other lateral side. In the embodiment shown in FIG. 18, the sealing flap is folded at an angle between 20 to 30 degrees relative to the transverse direction of the package, such that the new fold comes to lie perpendicular to the opening cut 7.

Exemplary data of the package shown in FIG. 15 and FIG. 17 are: a length of the package is 92 mm; a length of the sealing flap is 14 mm; a width of the package is 29 mm; a length of the opening cut is 5 mm; a closest distance of the opening cut from the edges of the sealing flap is 3.5 to 3.7 mm; an incomplete weakening line made by laser scoring; a width of longitudinal sealing is 4 mm.

Figure 19:
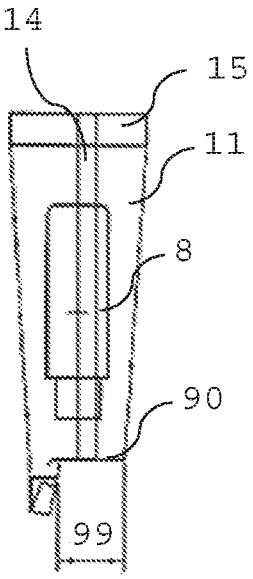
FIG. 19 illustrates another embodiment of an opened package, in accordance with an example embodiment.

FIG. 19 illustrates another embodiment of a package having one longitudinal sealing edge 14 and two opposed sealed end portions 15, 6 similar to the package of FIGS. 17 and 18. The package shown in FIG. 19 includes a conical shape such that the width of the sealing flap 6 is smaller than the width of the opposed sealed end portion 15. The width of the sealing flap is chosen such that the incomplete weakening line 90 defining the size of the opening of the pouch 11 allows convenient removal of the article 8 from the package. For example, a diameter 99 of the opening is about 15 millimeters with an article 8 having a diameter of between 8 millimeters and 13.5 millimeters.

The specific embodiments and examples described above illustrate but do not limit the example embodiments. It is to be understood that other embodiments may be made, and the specific embodiments and examples described herein are not exhaustive.

The invention claimed is:

1. A package for consumer goods, the package comprising:

a sheet material with a first end and a second end, the first end being connected to the second end to form a sealing flap, longitudinal edges of the sheet material being connected to each other, the sealing flap including a first fold line traversing a width of the sealing flap, the first fold line dividing the sealing flap into a first portion and a second portion, the first portion defining an opening cut that traverses through the first end and the second end along a longitudinal length of the sealing flap, the opening cut being between the first fold line and a distal most end of the sealing flap, the first portion including the distal most end of the sealing flap, the opening cut and the first portion being arranged in a sealed portion of the package such that the opening cut and the first portion are not visible or directly accessible if the package is in an assembled configuration, a first section of the sheet material forming a first package face, the sealing flap being connected to the first package face, a second fold line running along an edge of the width of the sealing flap and dividing the first package face from the second portion, the sealing flap defining an incomplete weakening line between the opening cut and the first package face, the incomplete weakening line being configured to redirect an opening motion of the package initiated at the opening cut to ensure that the first package face is not damaged during an opening of the package, the opening motion being redirected by the incomplete weakening line from a longitudinal direction along the longitudinal length to a transversal direction.

2. The package of claim 1, wherein the sealing flap is connected to the first package face such that the first portion is sealed between the second portion and the first package face.

3. The package of claim 1, wherein a first connection between the longitudinal edges of the sheet material is stronger than a second connection between the sealing flap and the first package face.

4. The package of claim 1, wherein the sheet material includes a center panel, a first side panel and a second side panel, the center panel forming a second package face for the package, the first side panel and the second side panel both depend from transverse sides of the center panel, the first side panel and the second side panel forming the first package face.

5. The package of claim 1, wherein the sheet material includes a first sheet face and a second sheet face, the longitudinal edges of the sheet material being connected to each other by the first sheet face being folded onto itself and sealed along the longitudinal edges, the first end being connected to the second end by connecting ends of the first sheet face to each other.

6. The package of claim 1, wherein the opening cut has a first length that is substantially parallel to the longitudinal length of the sealing flap.

7. The package of claim 6, wherein the opening cut is substantially centered along the width of the sealing flap.

8. The package of claim 1, wherein the opening cut does not traverse through the distal most end of the sealing flap.

9. The package of claim 1, wherein the opening cut runs substantially along a centerline of the longitudinal length of the sealing flap.

10. The package of claim 9, wherein the opening cut is configured to cause the sealing flap to be split into a first part and a second part, first part and the second part being substantially equal in size.

11. The package of claim 1, wherein the opening cut is defined to exist in a first line that is about perpendicular to the incomplete weakening line.

12. The package of claim 1, wherein the sheet material includes a center panel, a first side panel and a second side panel, the center panel forming a second package face for the package, the first side panel and the second side panel both depend from transverse sides of the center panel, the first side panel and the second side panel forming the first package face, the first package face and the second package face lying flat on each other.

13. The package of claim 12, wherein the opening cut does not traverse through the distal most end of the sealing flap.

* * * * *